United States Patent [19]

Morris et al.

[11] Patent Number: 4,702,717

[45] Date of Patent: Oct. 27, 1987

[54] METHOD OF MAKING ELECTRIC LAMP WITH INTERNAL CONDUCTIVE REFLECTOR

[75] Inventors: Merle E. Morris; Stephen P. Senft, both of Lexington, Ky.

[73] Assignee: GTE Products Corporation, Danvers, Mass.

[21] Appl. No.: 9,303

[22] Filed: Jan. 30, 1987

[51] Int. Cl.[4] ..... H01J 9/00; H01J 9/26

[52] U.S. Cl. ..... 445/27; 445/22; 445/44

[58] Field of Search ..... 445/22, 23, 27, 44; 313/25, 313

[56] References Cited

U.S. PATENT DOCUMENTS

| | | | |
|---|---|---|---|
| 3,211,938 | 10/1965 | Holcomb | 313/113 |
| 3,418,512 | 12/1968 | T'Jampens | 313/185 |
| 3,502,932 | 3/1970 | Berlec | 445/27 |
| 3,593,060 | 7/1971 | Kryder | 313/113 |
| 3,726,582 | 4/1973 | Tol | 445/44 |
| 4,580,989 | 4/1986 | Fohl | 445/22 |

*Primary Examiner*—Kurt Rowan

*Attorney, Agent, or Firm*—Lawrence R. Fraley

[57] ABSTRACT

A method of making a dual envelope lamp wherein a first envelope is formed having opposite sealed ends with conductive wires projecting therefrom. A formed reflector is welded at one end thereof to one wire and wrapped about the first envelope's opposite sealed end. Conductors are connected (welded) to the other wire and the opposite end of the reflector, respectively. This reflector, first envelope and conductor assembly is then slidably inserted within the open end of a piece of quartz tubing and a press sealed formed about the conductors. Subsequently, the tubing is flushed (e.g., with argon) and filled with an inert gas at a fixed pressure, followed by a tipping operation in which the opposite end of the tubing is sealed to thus define the second (outer) envelope.

11 Claims, 5 Drawing Figures

METHOD OF MAKING ELECTRIC LAMP WITH INTERNAL CONDUCTIVE REFLECTOR

TECHNICAL FIELD

The invention relates to methods of making electric lamps and in particular to electric lamps including an internal reflector. Examples are illustrated in U.S. Pat. Nos. 3,160,777 (Holcomb) and 3,211,938 (Holcomb). In addition to these, it is also known to utilize an internal reflector lamp wherein a pair of individual filament lamps are connected electricallly in series and are oriented within a rectangularly shaped outer envelope. The reflector, also rectangular in cross-section, is located substantially along one side of both individual lamps but electrically and structurally separated therefrom.

The lamp made in accordance with the teachings of the instant invention represents a significant improvment in the art through the utilization of an internal reflector which functions as part of the lamp's internal circuitry while also serving to reflect radiant energy in the form of light and/or heat from the lamp in a predetermined manner. Additionally, the reflector also functions to provide support for the lamp's light source (a sealed inner envelope having a filament structure therein) such that the source is strategically (e.g., centrally) disposed within the lamp's outer envelope (jacket). Connections to the invention are possible at only a single end thereof, thus facilitating placement (and connection) of the lamp within a desired environment (e.g., fixture socket).

It is believed that a method of making a lamp possessing the aforementioned characteristics would represent a significant advancement in the art.

DISCLOSURE OF THE INVENTION

It is a primary object of the invention to enhance the electric lamp art by providing a method of making an internal reflector electric lamp possessing, among others, the advantageous features mentioned above.

It is another object of the invention to provide such a method which can be carried out in a relatively inexpensive and expeditious manner, thus rendering the invention totally adaptable to mass production.

In accordance with one aspect of the invention, there is provided a method of making an electric lamp including the steps of forming an inner light-transmitting envelope having a filament therein and a pair of electrically conductive members projecting therefrom and electrically connected to the filament, electrically connecting an electrically conductive reflector at one end thereof to one of the electrically conductive members projecting from the inner envelope, securing the reflector at another end thereof to the inner envelope at a location distant from the electrical connection between the reflector and conductive member such that the reflector is positioned adjacent the inner envelope, electrically connecting a first electrical conductor to the other of the electrically conductive members projecting from the envelope and a second electrical conductor to the section of the reflector secured to the end of the inner envelope, slidably positioning the inner envelope, reflector and conductor assembly within an open end of a piece of light-transmitting tubing such that the conductors are aligned with a predetermined portion thereof, forming a sealed end about the conductors at the predetermined porrtion of the tubing such that parts of the conductors project externally of the sealed end, and thereafter sealing the opposing end of the tubing to define an outer envelope.

BEST MODE FOR CARRYING OUT THE INVENTION

For a better understanding of the present invention together with other and further objects, advantages and capabilities thereof, reference is made to the following disclosure and appended claims in connection with the above-described drawings.

Figure 1:
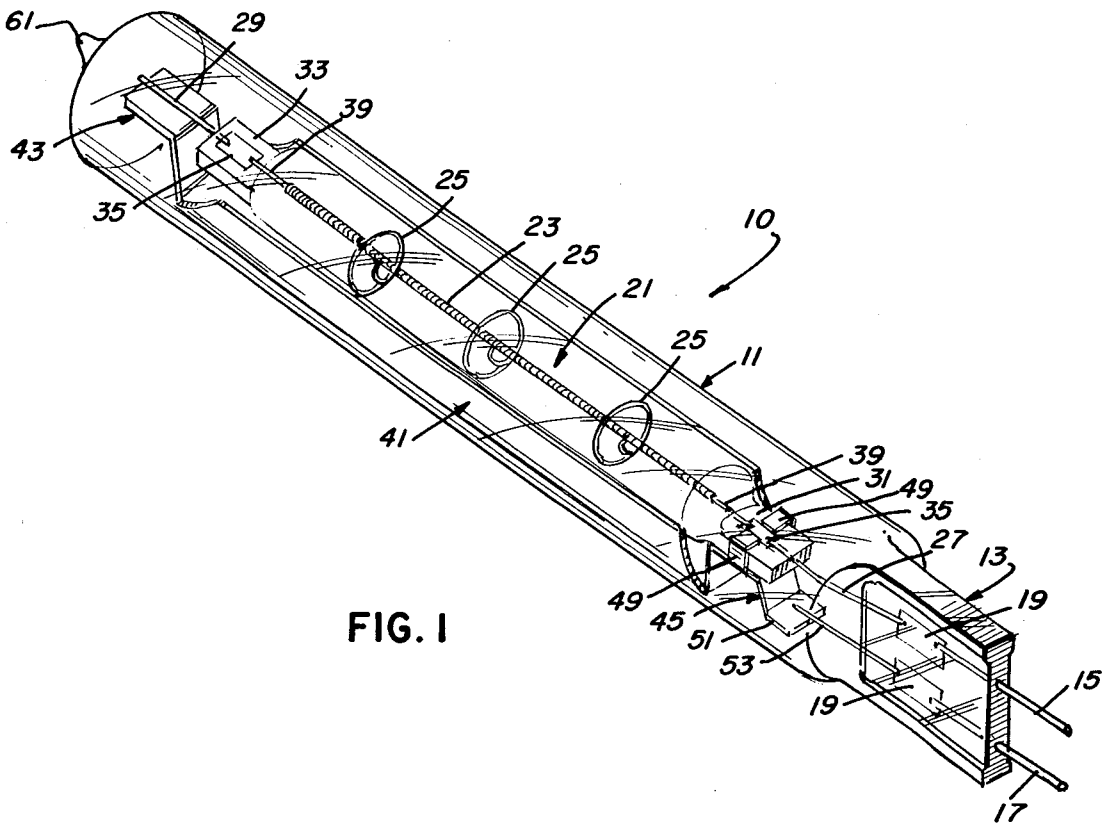
FIG. 1 is a perspective view of an electric lamp made in accordance with the teachings of the instant invention.

In FIG. 1, there is shown an electric lamp 10 made in accordance with the method of the instant invention. Lamp 10 includes an outer, light-transmitting envelope 11 having a sealed end portion 13 in which is positioned a pair of electrical conductors 15 and 17. Each of these conductors preferably comprises a molybdenum wire which projects externally of sealed end portion 13 and is connected at the other (inner) end thereof to a thin molybdenum foil 19 which is hermetically sealed within end 13. Located within outer envelope 11 is a sealed inner, light-transmitting envelope 21 which includes therein a coiled filament structure 23. In a preferred embodiment, filament structure 23 is a coiled tungsten filament and, as shown, is centrally disposed within the elongated inner envelope 21 by a plurality of coiled tungsten support wires (spacers) 25, examples of which are known in the art.

A pair of electrically conductive members 27 and 29 are electrically connected to opposing ends of the longitudinal filament 23 and project externally from opposing sealed end parts 31 and 33, respectively, of the sealed inner envelope 21. Each of the conductive members 27 and 29 is also preferably a molybdenum wire which, as shown, is attached (e.g., welded) to a thin molybdenum foil element 35 respectively sealed within the oposite end part of envelope 21. Another conductive wire 39 is attached to the opposite end of each sealed molybdenum foil 35 and extends inwardly of envelope 31 to be directly connected to the respective end of the tungsten filament structure 23. This inner envelope, filament and conductive member assembly thus serves as an inner bulb (light source) for the invention. That is, this inner bulb assembly is actually a lamp itself, having conductive members (wires) at opposite ends thereof.

Figure 2:
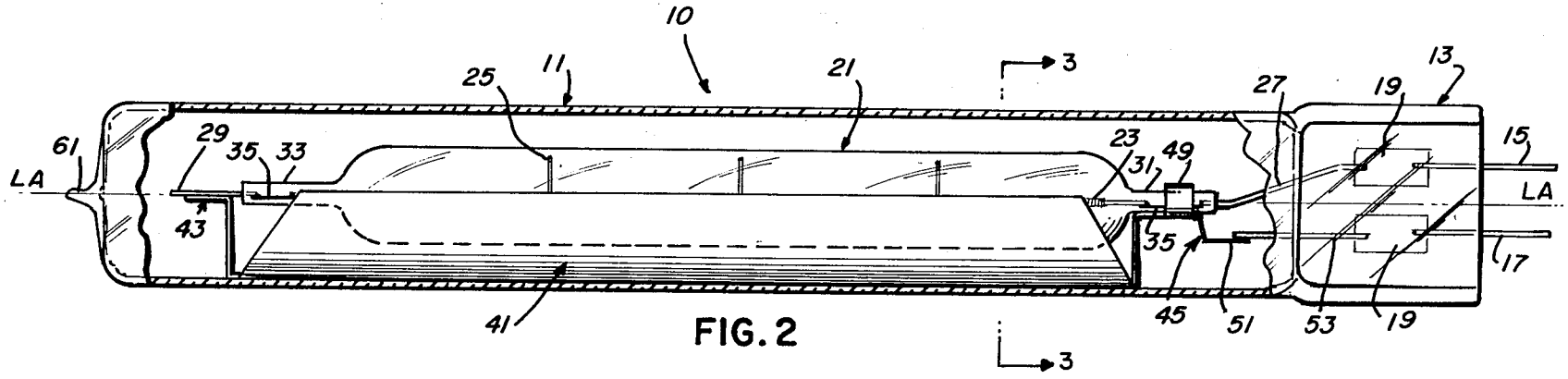
FIG. 2 is an enlarged, side elevational view, partly in section, of the lamp of FIG. 1.

As shown in FIG. 1, the conductive member 27 projecting externally from sealed end part 31 of the inner envelope is connected to the opposite end of the molybdenum foil element 19 secured to the first electrical conductor 15. Alternatively, an interim wire (not shown) can be secured to the opposite end of this molybdenum foil member to project internally of the outer envelope 11 and thus be directly attached (e.g., welded) to the conductive member 27. In either event, the wire (27 in FIG. 2) must be angularly bent (e.g., from about 10 to about 15 degrees) in the manner depicted to provide the necessary connection to foil 19. This is due primarily to the offset of the planar sealed end 13 relative to the corresponding planar sealed end 31 of the inner envelope and the fact that said wire is substantially centrally disposed within end 31. This offsetting arrangement (approximately 90 degrees as seen in FIGS. 1 and 2) assures central disposition of inner envelope 21 such that it can be effectively secured by the illustrated design of the invention's reflector (see below). It is of course possible to modify this orientation with a corresponding modification to the reflector's design.

In a preferred embodiment of the method taught herein, the inner envelope 21 is produced from quartz and contains a gas mixture therein established at approximately one atmosphere. This mixture is preferably argon with a halogen (e.g., bromine) dopant. The inner envelope 21 was sealed at opposite ends thereof using a press sealing operation known in the art. In one example, the inner envelope 21, illustrated as being of substantially cylindrical configuration, possessed an outer diameter (O.D.) of about 0.375 inch. In such an embodiment, outer envelope 11 was preferably also produced from quartz and possessed an outer diameter of about 0.625 inch.

As also shown in the drawings, the electric lamp as produced by the method defined herein further includes a thin, electrically conductive reflector 41 which is positioned within outer envelope 11 adjacent the elongated inner envelope 21 and is designed for reflecting radiant energy in the form of light and/or heat from the inner envelope in a predetermined direction through outer envelope 11. In the event that electric lamp 10 is to function as a heat (e.g., infrared) lamp (e.g., to be used in a paint or similar curing oven), reflector 41 thus functions to direct this infrared radiation in the desired direction. As shown in FIG. 1, reflector 41 includes an end section 43 which is directly connected to the conductive member 29 projecting externally from one of the sealed end parts of inner envelope 21. As seen in FIG. 2, end section 43 thus serves to support this end of the inner envelope such that it is substantially centrally disposed within outer envelope 11 so as to lie substantially along the longitudinal axis (LA-LA) of this outer, cylindrical envelope. End section 43 is preferably attached to conductive member 29 by welding. In a preferred embodiment, reflector 41 was formed of polished molybdenum and had a thickness of only about 0.003 inch. By the term thin is thus meant a thickness no greater than about 0.005 inch.

As further shown in FIGS. 1 and 2, reflector 41 includes an opposing end section 45 which also functions to support inner envelope 21, but at the opposite end from the reflector's first end section 43. This is achieved at end section 45 through the utilization of a strap member, separate from the reflector and perhaps attached (e.g., welded) thereto, or, alternatively, a pair of clip members which are attached (e.g., welded) to or which form extensions of end section 45. These embodiments are both represented by the numeral 49 in the drawings (FIGS. 1, 2). Should a strap member be used, it is preferably of metallic material (e.g., nickel) and, as shown, is wrapped about both the part of end section 45 abutting the sealed end 31 of the inner envelope as well as said sealed end. If clips are used, whether part of or separate elements from the reflector at this portion thereof, these are also wrapped about end 31 in the manner shown. End section 45 also includes a lower extension tab 51 which forms part of the reflector and which may rest (not shown) against an inner surface of outer envelope 11 to provide still greater support at this end of the assembly. Additionally, extension tab 61 is electrically connected to the end of the remaining molybdenum foil element 19 opposite the location of connection to the second electrical conductor 17. Such connection is preferably accomplished using an interim molybdenum conducting wire 53. Although secured about end part 31 of envelope 21, this part of the reflector is of course electrically isolated from conductive member 27.

It is thus seen that the conductive reflector 41 provides a means for electrically coupling the conductive member 29 to the second electrical conductor 17, thus providing a completed electrical circuit through the interior of outer envelope 11. The reflector is thus electrically connected in series with the described inner bulb (light source) such that both terminal ends of this circuit are located within the common, sealed end of the invention's outer envelope. A "single-ended" lamp (one having all connections at one end) has thus been provided.

Figure 3:
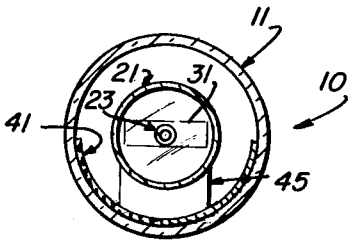
FIG. 3 is an enlarged cross-sectional view of the lamp of FIG. 1 as taken along the line 3—3 in FIG. 2.

As also shown in FIG. 3, reflector 41 is preferably formed of curvilinear (semi-circular) configuration and caused to rest against an internal surface of the cylindrical outer envelope 11 in a substantially flush arrangement, thus further illustrating the added support provided by reflector 11 in maintaining inner envelope 11 at the desired, substantially central position. The aforementioned completed circuit is thus provided in an expeditious manner without the need for added electrical connections or the like which would not only add to the complexity of such an arrangement but also to the cost thereof. The lamp produced in accordance with the method taught herein can thus be made in a relatively inexpensive and facile manner so as to be readily adaptable to mass production techniques in the lighting industry.

EXAMPLE

In one example, an electrical lamp was produced according to the method defined herein having an operational voltage of 120 volts, a wattage of about 1380 watts, and an approximate coil (filament) temperature of 2800 degrees Kelvin. A filament of about 260 millimeters (mm) was used and the finished product, including end connector (not shown) possessed an overall length of about 355 mm. During operation, the outer envelope possessed a minimum bulb wall temperature of about 250 degrees Celsius (C.) and a sealed end (13) temperature of about 350 degrees C. The aforementioned outer diameter dimensions for the inner and outer envelopes were utilized for this example, as were the defined materials for the respective connections (e.g., conductors 15 and 17).

Figure 4:
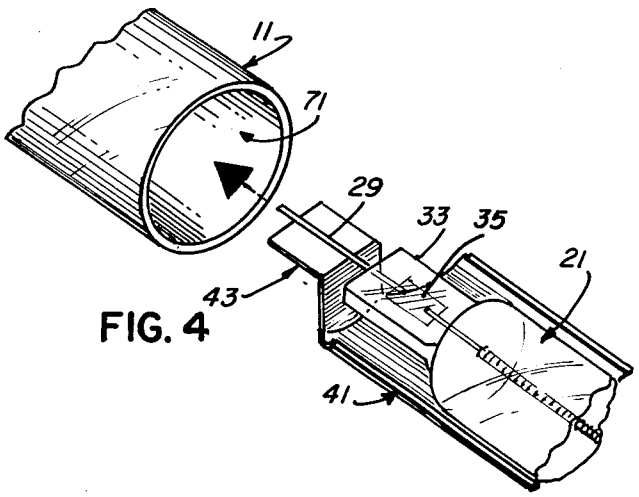
FIG. 4 is an enlarged, partial perspective view illustrating the slidable positioning of the assembled reflector and inner envelope within the open end of a piece of tubing which is to eventually form the outer envelope of the lamp produced using the invention's teachings.
Figure 5:
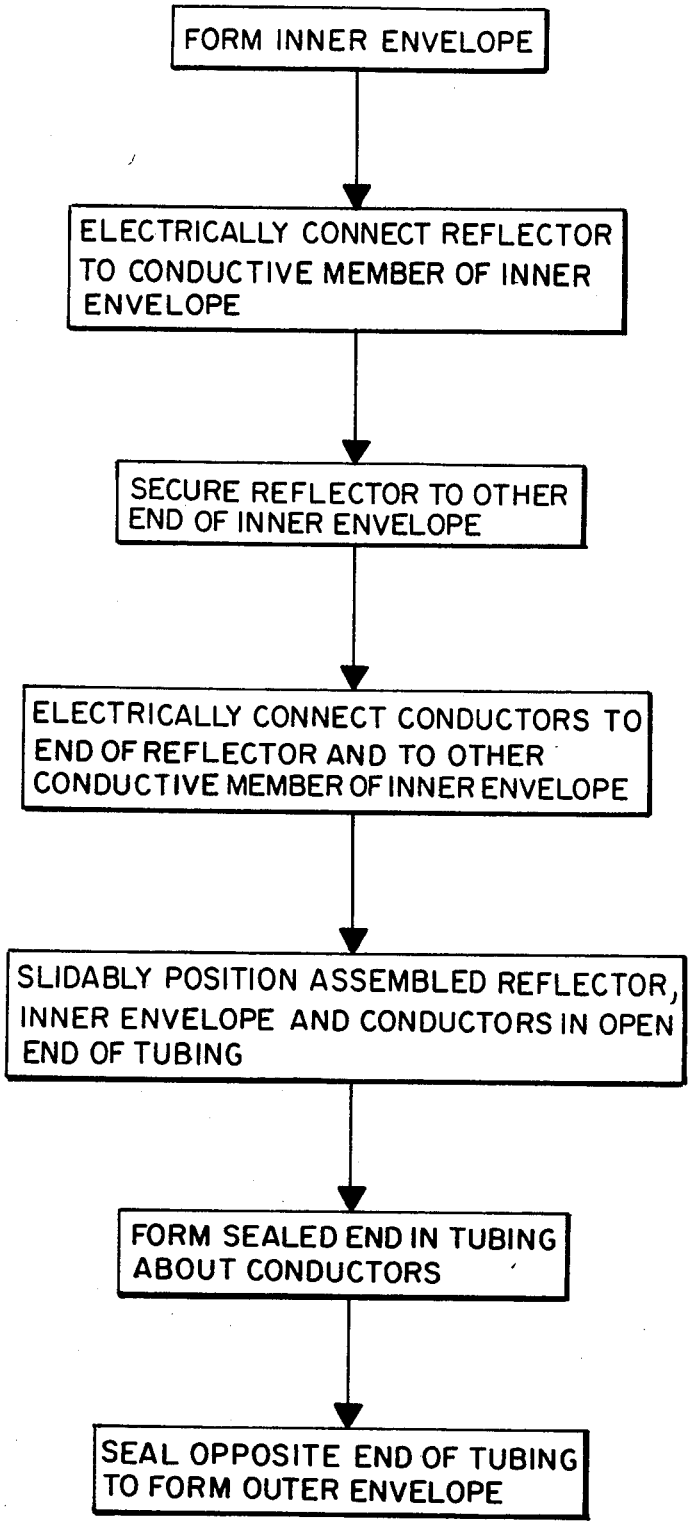
FIG. 5 is a flow diagram illustrating the steps of the invention.

In accordance with the teachings of the instant invention, assembly of electric lamp 10 is accomplished by first forming the inner envelope 21 having the elongated coiled tungsten filament 25 centrally disposed therein and the described, opposite press sealed end parts. This inner bulb is then attached to the reflector by firstly electrically connecting (welding) the end section 43 to projecting conductive member 29 and thereafter wrapping (securing) either the defined clip members or separate metallic strap member (49) about the inner bulb's opposing sealed end part (31), the reflector being electrically isolated from conductive member 27. Conductor 53 is then electrically connected (welded) to the extension tab 51 of end section 45. The described thin molybdenum foils 19 are then electrically connected (welded) to the ends of the conductive members 27 and 53 and the electrical conductors 15 and 17 are then electrically joined (welded) to opposite ends thereof. This entire assembly (inner envelope, reflector, foils and conductors) is then slidably positioned within the open end 71 of a cylindrical piece of glass tubing (11, FIG. 4) which eventually is to form outer envelope 11. The reflector, by slidably engaging the tubing's internal surfaces, simultaneously functions to center the contained (secured) inner envelope and conductive member assembly within the tubing. This was achieved, surprisingly, without harm to the polished reflector. With this assembly so positioned, sealed end portion 13 is formed using a press sealing operation known in the art to thus hermetically seal the foils 19 and respective portions of the conductors 15, 17, 27 and 53. Of significance, the aforedefined reflector-inner envelope assembly positioning facilitates alignment of the attached foils (19) and end conductors because of its relatively rigid structure, despite the sliding and other movement thereof. Sealing of end portion 13 is thus greatly faciliated. Once this sealed end portion is formed, the opposing end of the outer envelope 11, being open, is used to evacuate the envelope's interior (using a flushing operation including an inert gas such as argon) and add an inert gas (e.g., argon) thereto. A tipping operation is then utilized to tip the opposite end of the tubing which forms the outer envelope and thus provide a tipped section 61 (FIG. 1) thereon. Such a tipping operation is known in the art and further description is thus not believed necessary. The atmosphere for the described argon gas added to outer envelope 11 about the contained inner envelope and reflector assembly is preferably at a pressure of about one atmosphere. This method is depicted by the flow diagram shown in FIG. 5.

While there have been shown and described what are at present considered the preferred embodiments of the invention, it will be obvious to those skilled in the art that various changes and modifications may be made therein without departing from the scope of the invention as defined by the appended claims.

We claim:

1. A method of making an electric lamp comprising:

forming an inner light-transmitting envelope having a filament therein and a pair of electrically conductive members projecting therefrom and electrically connected to said filament;

electrically connecting an electrically conductive reflector at one end thereof to one of said electrically conductive members projecting from said inner envelope;

securing said reflector at another end thereof to said inner envelope at a location distant from said electrical connection between said reflector and conductive member such that said reflector is positioned adjacent said inner envelope;

electrically connecting a first electrical conductor to the other of said electrically conductive members projecting from said envelope and a second electrical conductor to said section of said reflector secured to said end of said inner envelope;

slidably positioning said inner envelope, reflector and conductor assembly within an open end of a piece of light-transmitting tubing such that said conductors are aligned with a predetermined portion thereof;

forming a sealed end about said conductors at said predetermined portion of said tubing such that parts of said conductors project externally of said sealed end; and sealing the opposing end of said tubing to define an outer envelope.

2. The method according to claim 1 wherein said reflector is electrically connected to said one of said conductive members projecting from said inner envelope by welding.

3. The method according to claim 2 wherein said reflector is secured to said another end of said inner envelope by wrapping a pair of clip members which are attached to or form part of said reflector or a strap member separate from said reflector about a sealed end part of said inner envelope.

4. The method according to claim 1 further including the step of electrically connecting a conductive foil to said other of said electrically conductive members projecting from said envelope and thereafter electrically connecting said first electrical conductor to said foil, said foil being sealed within said formed sealed end of said tubing.

5. The method according to claim 4 further including the steps of electrically connecting a conducting wire to said section of said reflector secured to said inner envelope and electrically connecting a second conductive foil to said conducting wire, said second electrical conductor being electrically connected to said second conductive foil, said second conductive foil being sealed within said formed sealed end of said tubing.

6. The method according to claim 1 wherein said forming of said sealed end about said conductors is accomplished by press sealing.

7. The method according to claim 1 further including flushing the interior of said tubing about said inner envelope subsequent to said forming of said sealed end.

8. The method according to claim 7 further including adding an inert gas at a preestablished pressure within said tubing about said inner envelope.

9. The method according to claim 1 wherein said opposing end of said tubing is sealed using a tipping operation.

10. The method according to claim 1 wherein said forming of said inner envelope having said filament therein includes providing a pair of sealed end parts within opposite ends of said inner envelope.

11. The method according to claim 10 wherein said sealed end parts are formed by press sealing.

* * * * *